US005336023A

United States Patent [19]

Burdine

[11] Patent Number: 5,336,023

[45] Date of Patent: Aug. 9, 1994

[54] SELF-PROPELLED TRENCH BOX

[76] Inventor: Clyde Burdine, Rte. 1, Box 34-A, Waitsburg, Wash. 99361

[21] Appl. No.: 3,647

[22] Filed: Jan. 12, 1993

[51] Int. Cl.[5] ..... E02D 17/08

[52] U.S. Cl. ..... 405/283; 405/157

[58] Field of Search ..... 405/154, 157, 174, 272, 405/282, 283; 37/359, 362, 365, 462, 463, 464, 364, 410, 499

[56] References Cited

U.S. PATENT DOCUMENTS

| | | | |
|---|---|---|---|
| 645,752 | 3/1900 | Mackey | 37/362 |
| 1,306,350 | 6/1919 | McIntire | 37/463 |
| 1,817,367 | 8/1931 | Greiman | 405/157 |
| 3,235,982 | 2/1966 | Krohn | 405/157 X |
| 3,309,799 | 3/1967 | Kinkade | 405/272 X |
| 3,710,583 | 1/1973 | Blackwell | 405/157 |
| 3,820,345 | 6/1974 | Brecht | 405/283 |
| 4,058,983 | 11/1977 | Griswold | 405/283 |
| 4,548,528 | 10/1985 | Bell | 405/283 |
| 4,874,271 | 10/1989 | Arnold | 405/283 |
| 5,123,785 | 6/1992 | Orfei | 405/283 |
| 5,193,938 | 3/1993 | Akesaka | 405/154 |

FOREIGN PATENT DOCUMENTS

| | | | |
|---|---|---|---|
| 8504438 | 10/1985 | PCT Int'l Appl. | 405/283 |
| 708855 | 5/1954 | United Kingdom . | |

*Primary Examiner*—Randolph A. Reese
*Assistant Examiner*—John A. Ricci
*Attorney, Agent, or Firm*—Wells, St. John, Roberts, Gregory & Matkin

[57] ABSTRACT

A self-propelled trench box includes a pair of side panel enclosures and respective drive tracks mounted within the enclosures. The drive tracks are powered by a compact hydraulic drive mechanism mounted within the trench box to move the trench box in either direction within the trench. A plurality of track path plows are mounted to each side panel enclosure to clear loose material from the paths of the drive tracks to facilitate movement of the trench box within the trench.

15 Claims, 6 Drawing Sheets

SELF-PROPELLED TRENCH BOX

TECHNICAL FIELD

This invention relates to trench boxes used for preventing broken material from falling inside a working areas of trenches.

BACKGROUND OF THE INVENTION

Trenches or ditches are commonly excavated so that pipe, cable, or other materials can be installed underground. When digging trenches and working within trenches, a difficulty arises with respect to supporting the sidewalls of the trench so that debris and other loose material does not fall into a working area of the trench. There are also problems with respect to safety of workers within the trench where falling material may strike the persons working within the trench.

Stationary trench boxes have traditionally been used within trenches to provide a working area for workers. The trench boxes are typically employed after a backhoe or other excavating device digs the trench. The primary purposes of the trench boxes include preventing loose or broken material from falling into the working area of the trench and injuring workers within the trench, and to simply maintain the working area free of such loose or broken material. Traditional trench boxes do not perform excavating functions, since their primary purpose is to provide a partitioned working area.

A traditional trench box comprises two sidewalls and interconnecting structural members. It is generally desirable to leave as much space as possible within the two side panels to allow the workers to move about within the trench box while laying pipe, cable, or performing repair work.

Traditional trench boxes have traditionally been moved by a crane or another lifting mechanism by lowering the trench box into the trench. Once in the trench, they have traditionally been moved back and forth in the trench by a backhoe that has dug the trench or another separate piece of machinery. In the case of the backhoe, it is required to perform a double duty: dig the trench and move the trench box back and forth within the trench. This, of course, slows down the efficiency and speed of work that can be performed within the trench.

Because of the traditional bulkiness of equipment needed to move a large piece of equipment such as a trench box, a means for propelling a trench box has not been suitably provided in prior trench boxes because of the amount of space the drive means would require within the trench box.

Some prior self-propelled excavating equipment have included various types of trench-shoring structures. However, such excavating devices cannot be suitably employed as trench boxes because of the lack of working space inside these devices. The inside working area of many such traditional excavating machines having trench shoring features are overly cluttered with structures and other machinery, which deprives the workers of a suitable amount of area within the trench box for performing their work.

Accordingly, there is a need to provide a trench box that is capable of moving itself within the trench. There is also a need to provide such a self-movable trench box without including excessive equipment and structures inside the trench box area so that there remains sufficient room for workers to move about within the trench box. There is a further need to develop a self-propelled trench box which will clear and grade the bottom surface of the trench so that the trench box can move back and forth within the trench without being obstructed by broken or loose material that has fallen from the sidewalls of the trench.

BRIEF DESCRIPTION OF THE DRAWINGS

FIG. 4 is a selectional right side elevational view, taken along the line 4—4 of FIG. 3, of a side panel enclosure of the trench box of FIG. 1.

DETAILED DESCRIPTION OF THE INVENTION

This disclosure of the invention is submitted in furtherance of the constitutional purposes of the U.S. Patent Laws "to promote the progress of science and useful arts" (Article 1, Section 8).

Figure 1:
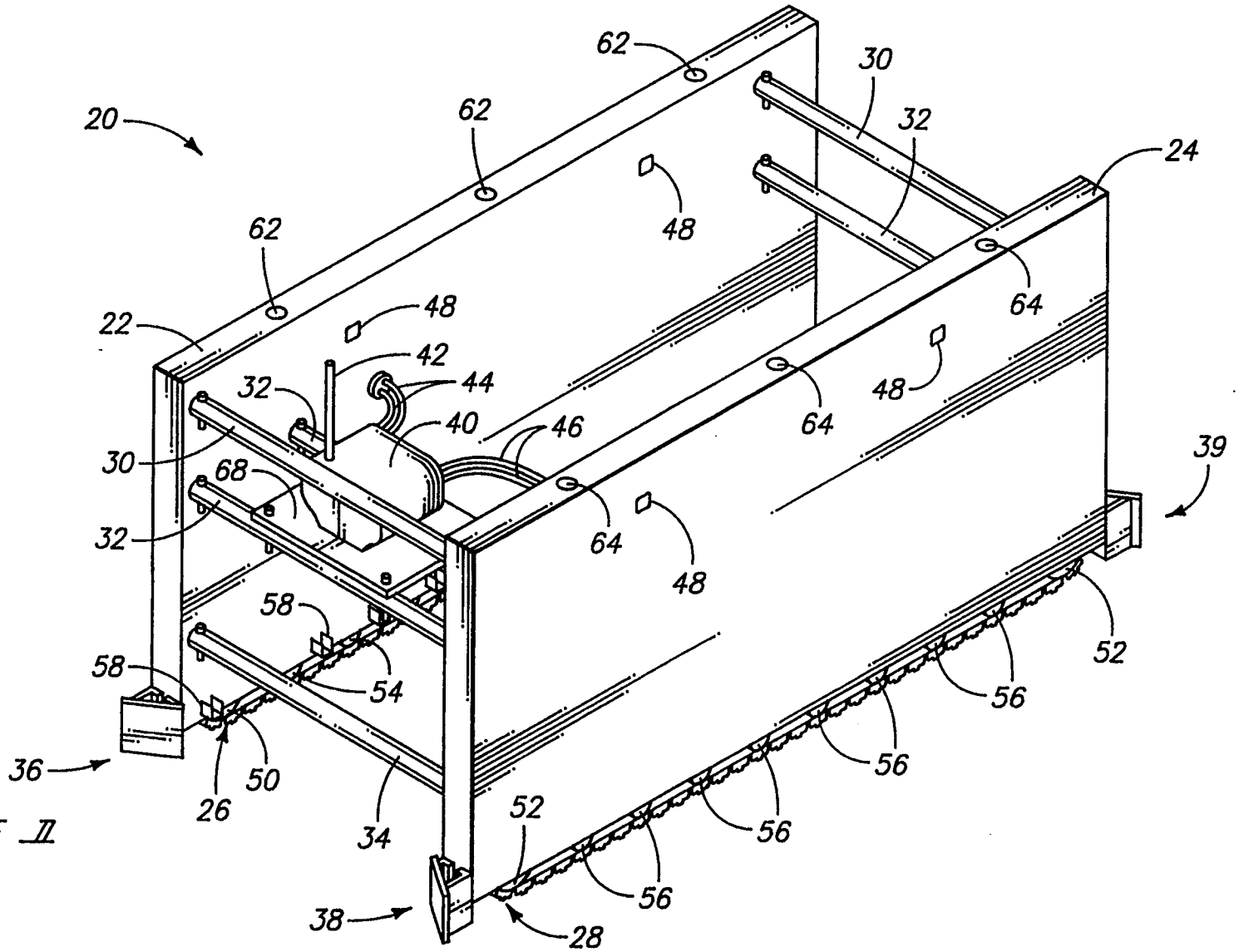
FIG. 1 is an isometric view of a preferred embodiment of a self-propelled trench box according to the present invention.
Figure 5:
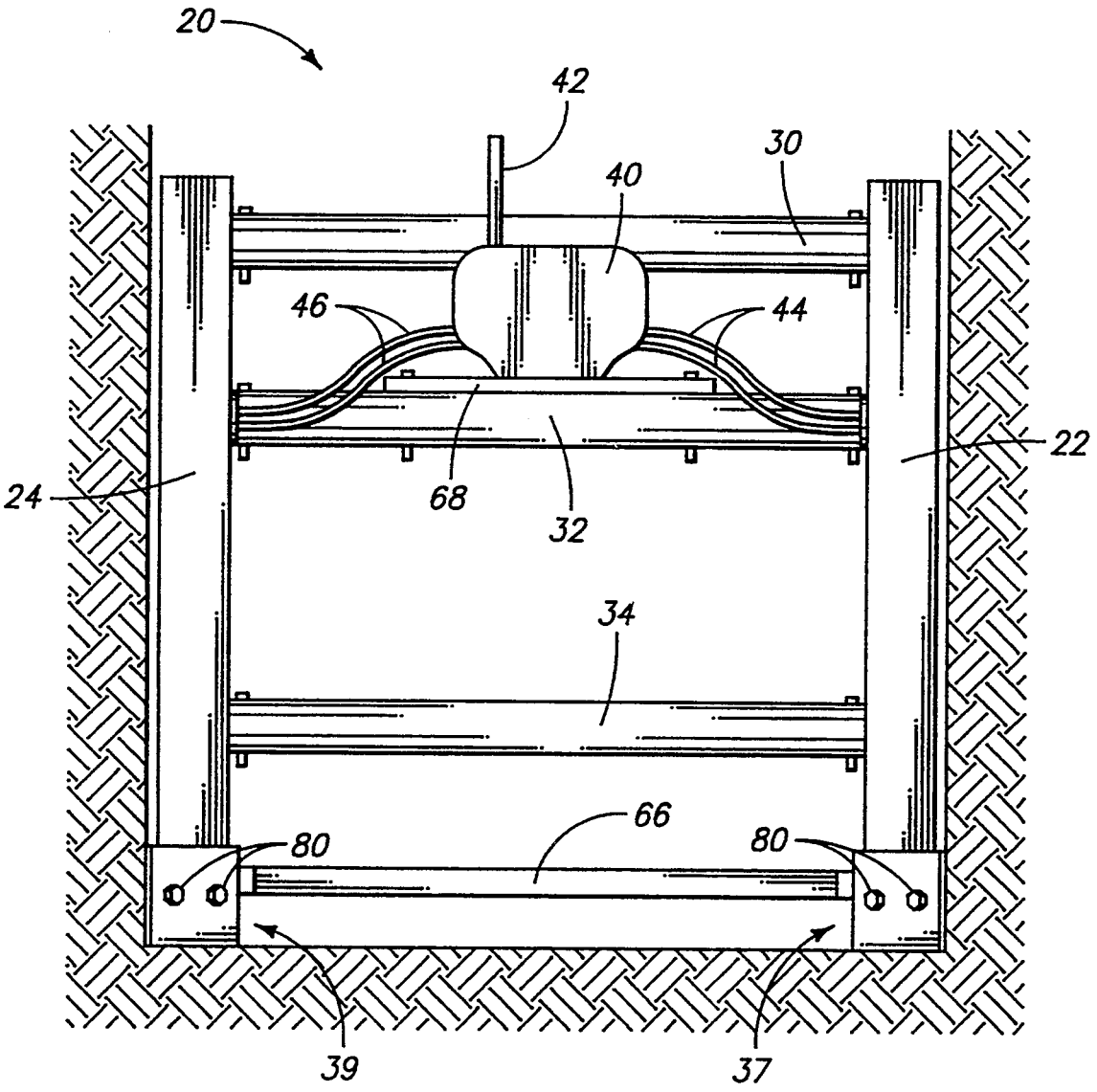
FIG. 5 is a rear elevational view of the trench box of FIG. 1.

As shown in the figures, the present invention involves a trench box 20 having opposed side panels in the form of a first side panel enclosure 22 and a second side panel enclosure 24. The side panel enclosures 22, 24 are intended to be positioned adjacent opposite walls of a trench (FIG. 5). As shown in FIG. 1, each side panel enclosure includes opposed side walls, opposed end walls, and a top wall. The bottoms of the side panel enclosures are open to allow the drive tracks 26, 28 (explained in greater detail below) to extend beyond the enclosures and engage the bottom surface or floor of the trench.

The side panel enclosures serve to prevent broken material and other debris from falling into the working area inside the trench box. Besides protecting the workers and preventing broken material from collecting on the bottom of the trench within the working area, the side panel enclosures also prevent material from falling into the middle of the trench and impeding movement of the trench box within the trench.

The trench box 20 may be used in connection with virtually any work activity that is performed within trenches, such as, for example, laying pipe or cable, or for any type of repair work to be performed within a trench.

Multiple cross bars, including top cross bars 30, middle cross bars 32, and bottom cross bars 34 (only one shown in FIG. 1), interconnect the side panel enclosures 22, 24. The cross bars 30, 32, 34 are positioned only at extreme ends of the side panels to provide a relatively unobstructed work area within the trench box.

The cross bars 30, 32, 34 are readily interchangeable with other cross bars of different lengths. Any conventional mounting arrangement may be used in conjunction with the cross bars. Thus, the width of the trench box 20 can be varied to accommodate a variety of trench widths. The interchangeability of the cross bars enables quick and easy transition of the trench box to a different width. This adjustment capability is due in major part to the simple and minimum number of structural members located within the trench box that interconnect the side panel enclosures 22, 24.

A first drive track 26 and a second drive track 28 are operatively coupled the first and second side panel enclosures 22, 24, respectively. The drive tracks 26, 28 allow the trench box 20 to move in either direction within the trench.

Referring still to FIG. 1, the drive tracks 26, 28 are mounted within the respective side panel enclosures 22, 24. The side panel enclosures protect the drive tracks from damage from falling loose material and from the work being performed within the trench box. In a preferred embodiment, the width of the side panel enclosure is approximately 8 inches and the width of a drive track is 6 inches, although other dimensions could also be employed.

Figure 2:
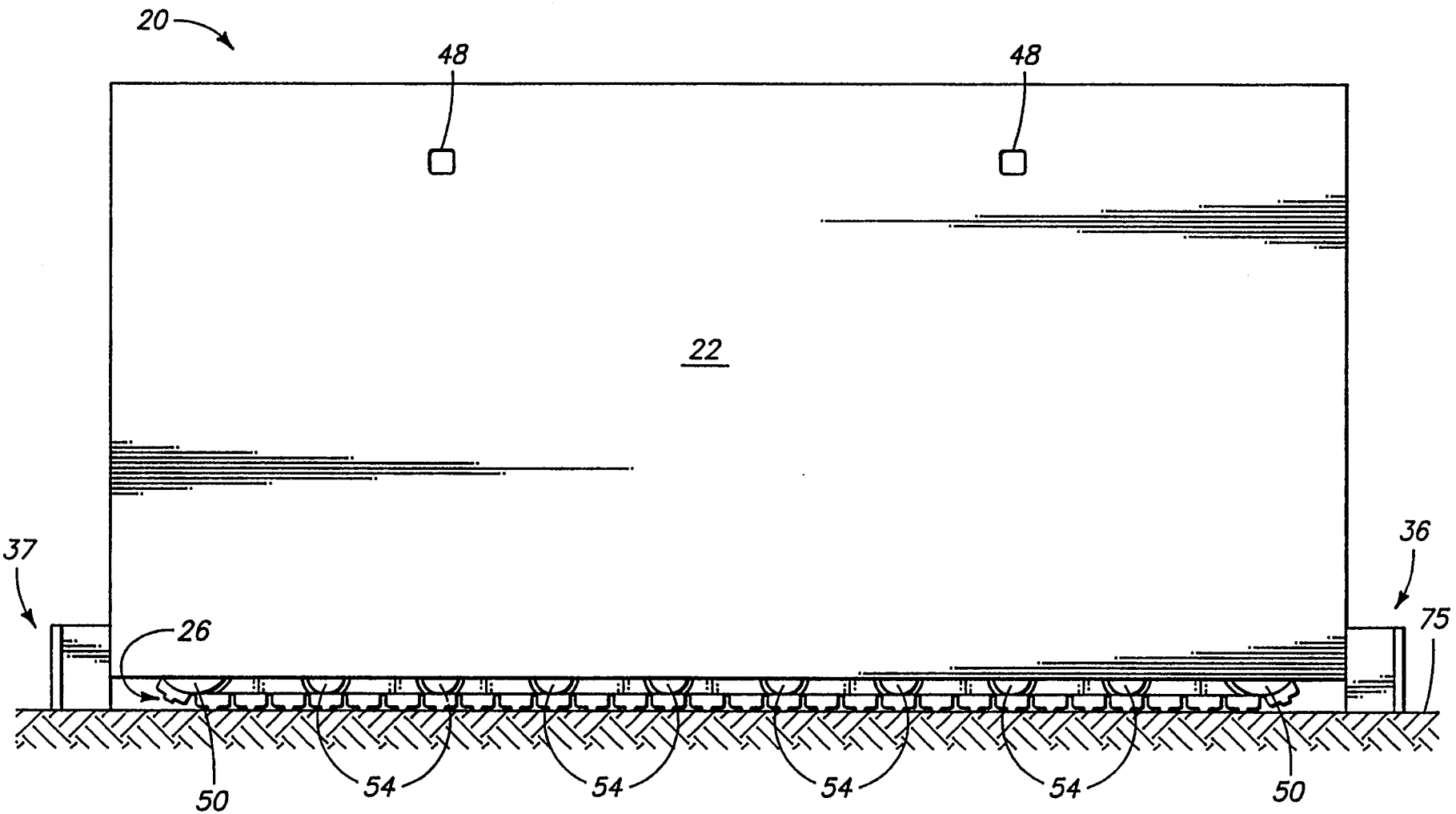
FIG. 2 is a left side elevational view of the trench box of FIG. 1.

Referring to FIGS. 2 and 4, the drive tracks 26, 28 are entrained over a plurality of idler support wheels 54, 56. The drive tracks 26, 28 are further entrained over pairs of idler rollers 50, 52 located at the lower ends drive tracks. The wheels and idler rollers provide a supportive force to the drive tracks while allowing the tracks to move freely along the support wheels.

FIG. 4 shows the second drive track 28 in greater detail. The first drive track 26 (not shown in FIG. 4) is constructed in a similar manner as compared to the second drive track 28. The first drive track is comprised of a series of interconnected track links 74 which form a continuous drive track. Upper idler support rollers 72 are mounted within the side panel enclosure 24 to provide a supportive force to the drive track 28.

Drive track 28 is driven by a drive gear 70 which is operatively coupled to a hydraulic drive mechanism by a pair of hydraulic hoses 46. Depending on the direction of travel desired, hydraulic pressure will be supplied to the drive gear 70 through the particular hydraulic hose that will cause drive gear 70 to rotate in the desired direction.

Still referring to FIG. 4, the support wheels 56, the upper support rollers 72, the idler rollers 52, and the drive gear 70 are rotatably mounted to the side walls which form part of the side panel enclosure 24. The enclosure prevents damage to the rollers, drive gear and drive track by external factors.

A compact drive mechanism or drive means 40 powers the drive tracks 26, 28. The drive mechanism is preferably hydraulic, which greatly reduces the number of structural members and other equipment needed to be located within the trench box 20. This, in turn, allows more working room within the trench box.

In a preferred embodiment, the drive mechanism 40 comprises a combined gasoline motor and hydraulic pump mounted on a mounting plate 68. The plate is mounted, in turn, on pair of middle cross bars 32. The drive mechanism 40 generates hydraulic pressure, controlled by control valves within the drive mechanism housing, which transmits a driving force to each of the drive tracks 26, 28.

Figure 3:
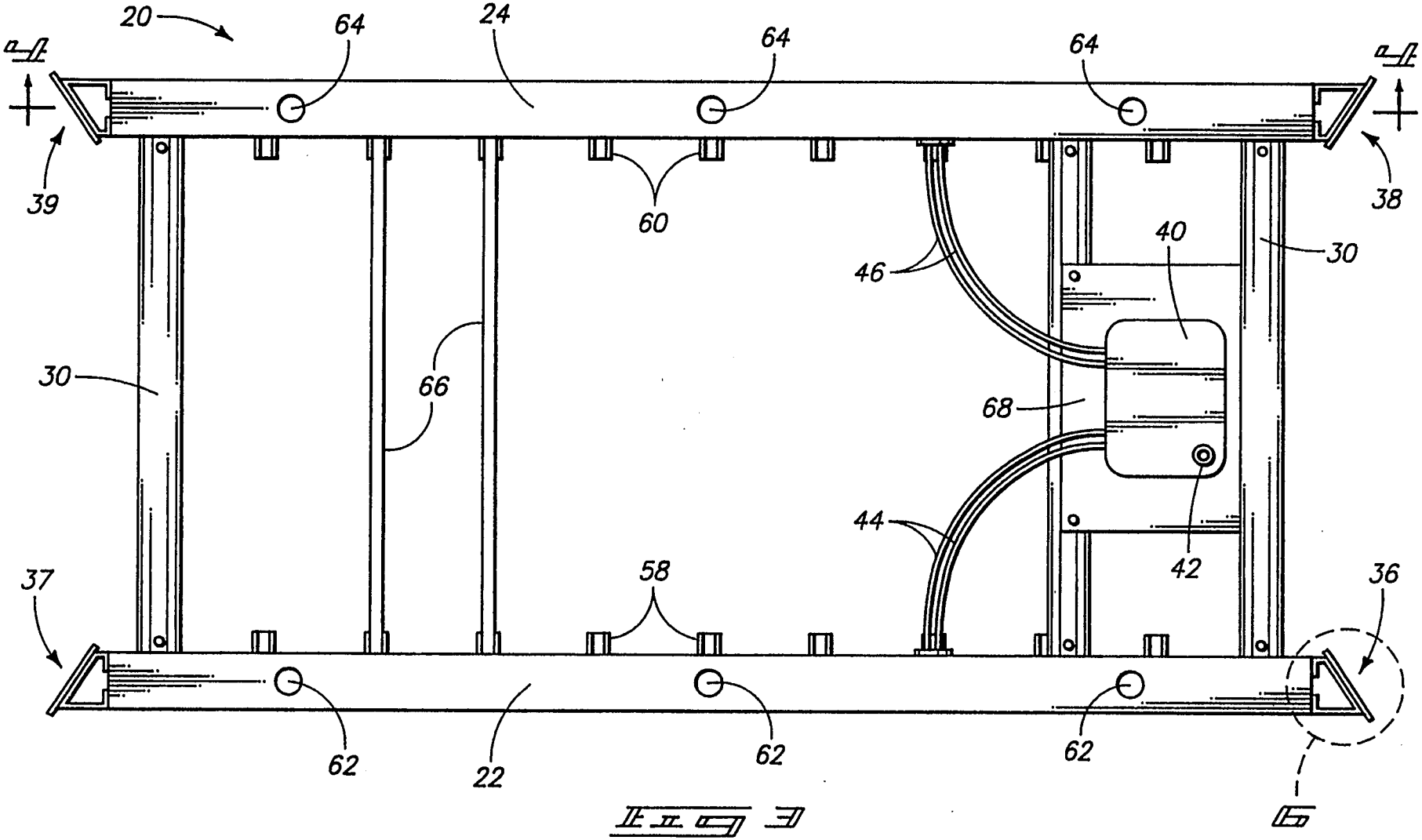
FIG. 3 is a top view of the trench box of FIG. 1.
Figure 11:
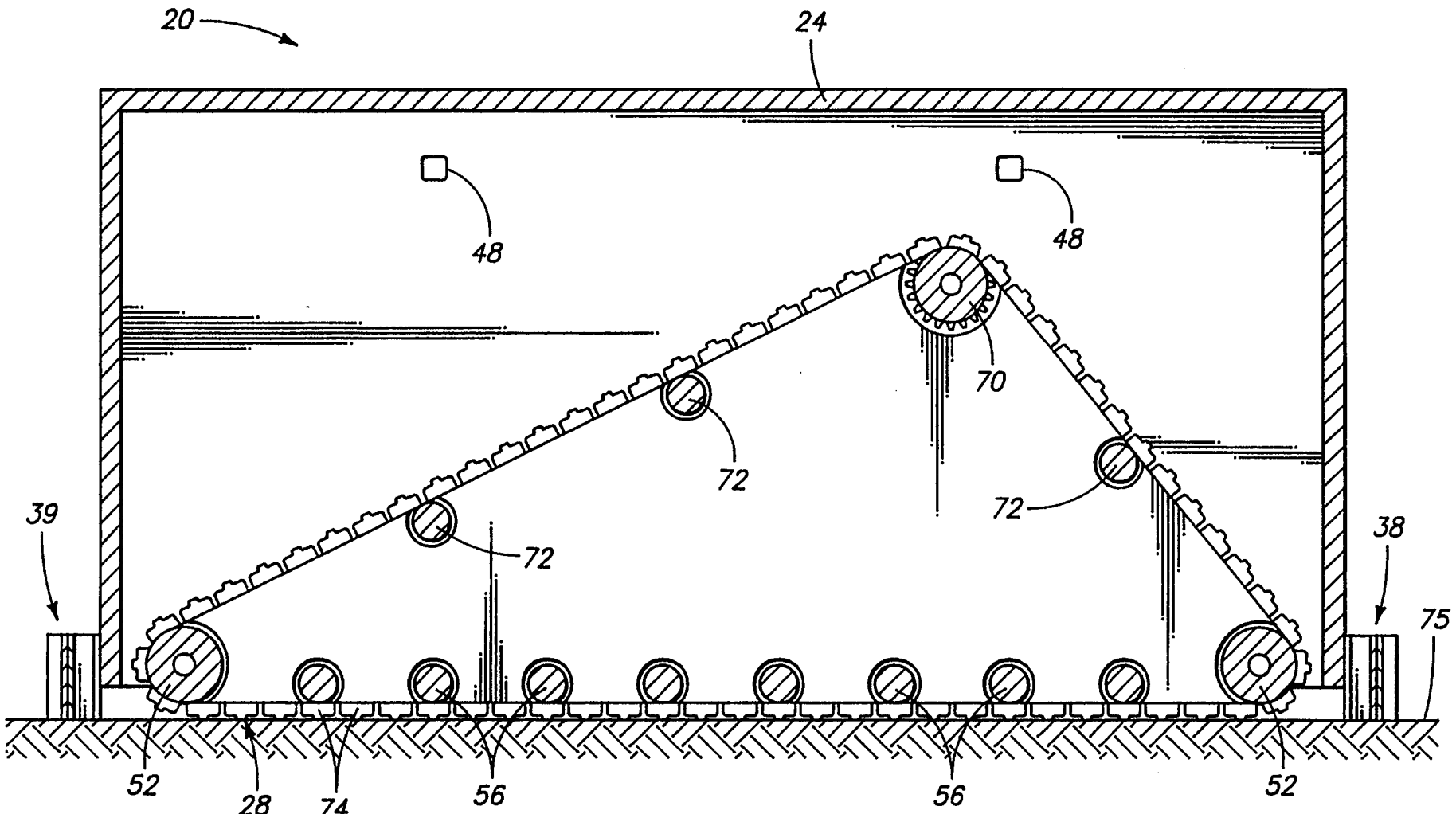

More specifically, with reference to FIG. 1, 3, and 5, the hydraulic fluid pressure is to be supplied to the drive gears by means of a first pair of hydraulic hoses 44 and a second pair of hydraulic hoses 46. An exhaust stack 42 extends upwardly from the drive mechanism housing 40 for removing exhaust fumes from the trench. The exhaust stack may extend as high as necessary to insure that noxious fumes and gases from the drive mechanism are discharged from the trench.

Multiple lift tubes 48 are provided in each sidewall panel 22, 24 of the trench box 20. The lift tubes extend from one side wall of the enclosure to the opposite side wall. A primary purpose of the lift tubes is to provide a lifting location for the trench box 20. The trench box could be lifted with any conventional lifting device, such as a crane or a back hoe.

With reference to FIGS. 1 and 3, connection points 62, 64 are provided in the top wall of each respective side panel enclosure 22, 24. The connection points 62, 64 allow multiple stackable trench box units to be stacked on top of one another. The number of stackable units will depend upon the depth of the trench. A preferred height of a trench box is approximately 8 feet, although other heights are also contemplated.

As shown in FIGS. 1 and 3, the trench box also includes a plurality of inner support brackets 58, 60 coupled to the respective side panel enclosures 22, 24. These inner support brackets provide a means for mounting and supporting one or more pipe installation bars 66. The pipe installation bars can be easily moved between any of the support brackets 58, 60 of the trench box 20.

A plurality of track path plows 36, 37, 38, 39 are coupled to the lower portion of the end walls of the fore and aft ends of the side panel enclosures 22, 24. The track path plows serve to clear broken, collected material or other debris from the path of the drive tracks 26, 28, and grade the floor of the trench in front of the drive tracks. The dual pairs of track path plows allow paths to be cleared when the trench box 20 travels in a forward or reverse direction.

Figure 6:
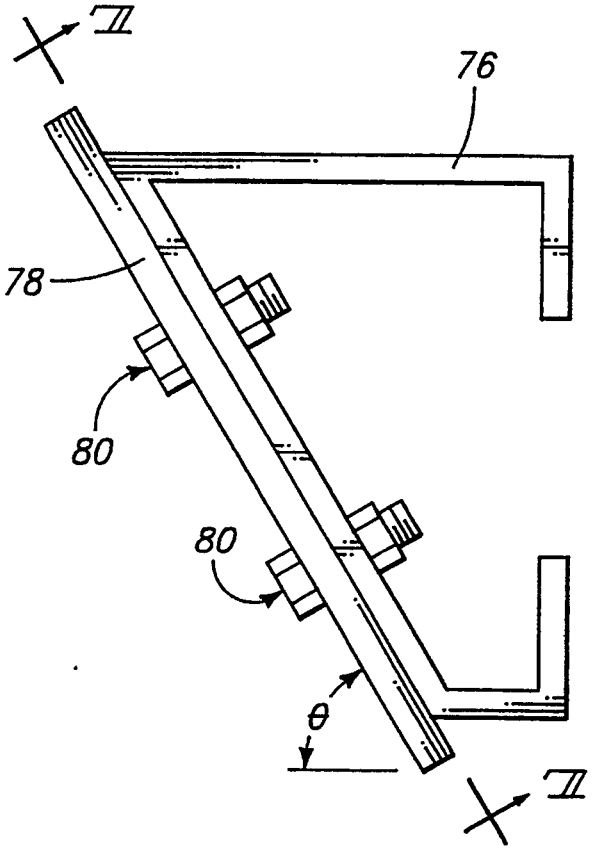
FIG. 6 is an enlarged top view, taken from area 6 of FIG. 3, of a preferred embodiment of a track path plow used in conjunction with the trench box of FIG. 1.
Figure 7:
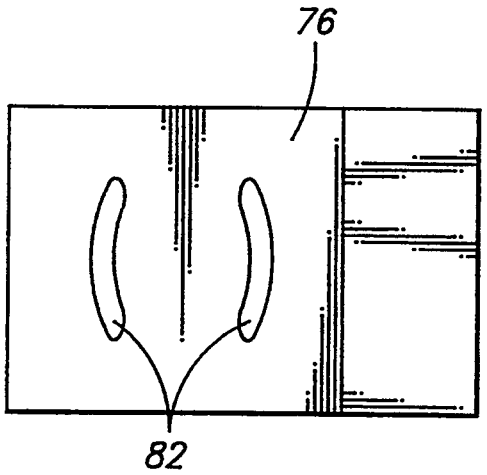
FIG. 7 is a side elevational view, taken along the line 7—7 of FIG. 6, of a track path plow mounting bracket.

Referring to FIGS. 6 and 7, each track path plow 36, 37, 38, 39 includes a dozer blade 78 coupled to a track plow mounting bracket 76 by means of two nut-and-bolt connections or fasteners 80. Each mounting bracket 76 is coupled to lower portions of the end walls of the side panel enclosures 22, 24. The dozer blade 78 is inclined at an angle $\theta$ so that material on the bottom of the trench will be directed toward the inside of the trench box away from the path of the drive tracks. In a preferred embodiment, this angle is 45 degrees, although other angles could also be used.

FIG. 7 shows a pair of arc-shaped slots 82 in the mounting bracket 76 through which the fasteners 80 are mounted. The slots 82 allow the horizontal orientation or alignment of the dozer blade 78 to be adjusted according to the desired path to be graded at the bottom of the trench. Therefore, the track path plows 36, 37, 38, 39 are adjustable by means of fasteners 80 and slots 82; that is, the adjustment fasteners mounting the dozer blade to the mounting bracket allow the dozer blade to be aligned to clear and grade the ground in front of the drive tracks at a desired slope. The fasteners 80 also allow the track path plows to be completely removed if desired.

In compliance with the statue, the invention has been described in language necessarily limited in its ability to properly convey the conceptual nature of the invention. Because of this inherent limitation of language, it must be understood that the invention is not necessarily limited to the specific features described, since the means herein disclosed comprise merely preferred forms of putting the invention into effect. The invention is, therefore, claimed in any of its forms or modifications within the proper scope of the appended claims appropriately interpreted in accordance with the doctrine of equivalents.

I claim:

1. A self-propelled trench box apparatus, comprising:

a first side panel positionable adjacent a first wall of a trench;

a second side panel positionable adjacent a second wall of the trench;

multiple cross bars interconnecting the side panels at a distance which corresponds substantially to a width of the trench, the cross bars interconnecting the first and second side panels in a parallel relationship to one another, the cross bars spacing the side panels to create an open work area in which workers may above about to perform work within the trench;

a first drive track operatively connected to and being received within the first side panel;

a second drive track operatively connected to and being received within the second side panel; and a drive mechanism powering the first and second drive tracks to move the trench box within the trench.

2. The self-propelled trench box apparatus of claim 1 wherein the cross bars are positioned only at extreme ends of the side panels to provide a relatively unobstructed work area within the trench box.

3. The trench box apparatus of claim 1 wherein the cross bars include top cross bars, middle cross bars, and bottom cross bars coupled to the side panels only at extreme ends thereof to provide lateral support for the first and second side panels.

4. The trench box apparatus of claim 1 wherein the drive mechanism allows the trench box to be moved in either direction within the trench.

5. The trench box apparatus of claim 1, further comprising:

multiple track path plows coupled to the side panels, each track path plow including a dozer blade for clearing loose material away from the path over which the drive tracks will pass, the track path plows each being adjustable.

6. The self-propelled trench box apparatus of claim 1 wherein the drive mechanism is a compact hydraulic drive mechanism.

7. The self-propelled trench box apparatus of claim 1 wherein the drive mechanism is a compact hydraulic drive mechanism including a motor and associated hydraulic pump, the drive tracks being driven by transmission of a pressurized hydraulic fluid generated by the pump to respective gears which power the drive tracks.

8. The self-propelled trench box apparatus of claim 1, further comprising multiple lift tubes disposed within the side panels for providing lifting locations for the trench box.

9. The self-propelled trench box apparatus of claim 1, further comprising multiple connection points provided on the side panels for allowing additional trench box units to be stacked on top of the trench box.

10. A self-propelled trench box apparatus, comprising:

a first side panel positionable adjacent a first wall of a trench;

a second side panel positionable adjacent a second wall of the trench;

multiple cross bars interconnecting the side panels at a distance which corresponds substantially to a width of the trench, the cross bars interconnecting the first and second side panels in a parallel relationship to one another, the cross bars spacing the side panels to create an open work area in which workers may move about to perform work within the trench;

a first drive track operatively connected to the first side panel;

a second drive track operatively connected to the second side panel;

a drive mechanism powering the first and second drive tracks to move the trench box within the trench; and multiple track path plows coupled to the side panels, each track path plow comprising:

a mounting bracket coupled to a lower portion of an end wall of a respective side panel;

a dozer blade coupled to the mounting bracket, the dozer blade being aligned to clear and grade the ground over which the drive tracks will pass; and a pair of adjustment fasteners mounting the dozer blade to the mounting bracket, the adjustment fasteners allowing the dozer blade to be adjusted to clear the ground at a desired slope.

11. The trench box apparatus of claim 10 wherein pairs of the multiple track path plows are coupled to the fore and aft ends of the side panels to allow the track path plows to clear loose materials when the trench box is propelled in either direction within the trench.

12. A self-propelled trench box apparatus, comprising:

a first side panel enclosure positionable adjacent a first wall of a trench;

a second side panel enclosure positionable adjacent a second wall of the trench;

multiple cross bars interconnecting the side panel enclosures at a distance which corresponds substantially to a width of the trench, the cross bars interconnecting the first and second side panel enclosures in a parallel relationship to one another, the cross bars being mounted only at extreme ends of the side panel enclosures and spacing the side panel enclosures to create an open, relatively unobstructed work area in which workers may move about to perform work within the trench;

a first drive track operatively connected to the first side panel enclosure;

a second drive track panel operatively connected to the second side panel enclosure;

the first and second drive tracks being substantially enclosed by the respective first and second side panel enclosures; and a compact hydraulic drive mechanism powering the first and second drive tracks to move the trench box in either direction within the trench.

13. The trench box apparatus of claim 12, further comprising:

multiple track path plows coupled to the side panels, each track path plow comprising:

a mounting bracket coupled to a lower portion of an end wall of a respective side panel;

a dozer blade coupled to the mounting bracket, the dozer blade being aligned to clear the ground over which the drive tracks will pass; and a pair of adjustment fasteners mounting the dozer blade to the mounting bracket, the adjustment fasteners allowing the dozer blade to be adjusted to clear the ground at a desired slope;

wherein pairs of the multiple track path plows are coupled to the fore and aft ends of the side panels to allow the track path plows to clear loose material when the trench box is propelled in either direction within the trench.

14. The self-propelled trench box apparatus of claim 13, further comprising multiple lift tubes disposed within the side panel enclosures for providing lifting locations for the trench box.

15. The self-propelled trench box apparatus of claim 14, further comprising multiple connection points provided on the side panels for allowing additional trench box units to be stacked on top of the trench box.

* * * * *